US005186133A

United States Patent [19]

Watanabe et al.

[11] Patent Number: 5,186,133

[45] Date of Patent: Feb. 16, 1993

[54] FUEL ENRICHMENT ARRANGEMENT FOR MARINE PROPULSION UNIT

[75] Inventors: Takahide Watanabe; Yasuhiko Shibata; Shoichi Mitsui; Takashi Koike, all of Hamamatsu, Japan

[73] Assignee: Sanshin Kogyo Kabushiki Kaisha, Hamamatsu, Japan

[21] Appl. No.: 823,681

[22] Filed: Jan. 21, 1992

[30] Foreign Application Priority Data

Jan. 25, 1991 [JP] Japan ..... 3-25279

[51] Int. Cl.[5] ..... F02M 1/12

[52] U.S. Cl. ..... 123/179.14; 123/179.15; 123/179.29

[58] Field of Search ..... 123/179.14, 179.15, 123/179.12, 179.13, 179.16, 179.18, 179.28, 179.29

[56] References Cited

U.S. PATENT DOCUMENTS 4,986,229 1/1991 Suzuki et al. ..... 123/179.14

5,121,719 6/1992 Okazaki et al. ..... 123/179.14

*Primary Examiner*—Andrew M. Dolinar

*Attorney, Agent, or Firm*—Ernest A. Beutler

[57] ABSTRACT

The present invention provides a device for controlling the air/fuel mixture ratio during the starting period for an outboard motor. Specifically, a positive temperature coefficient (PTC) heater controls a fuel flow regulating valve at an engine's charge forming device. A multipolar generator is used as an exclusive power source for the PTC heater. The arrangement of the invention has a relatively simple construction and can be used with propulsion units which do not have batteries.

15 Claims, 7 Drawing Sheets

FUEL ENRICHMENT ARRANGEMENT FOR MARINE PROPULSION UNIT

BACKGROUND OF THE INVENTION

This invention relates to a fuel enrichment arrangement for a marine propulsion unit, and more particularly to a device for controlling the air/fuel mixture ratio during the starting period for an outboard motor.

An air-fuel ratio is the ratio of air to fuel mixed by a charge forming device of an engine. A low ratio of air to fuel is known as a rich mixture of fuel, while a high ratio of air to fuel is known as a lean mixture. Under a great many operating conditions, rich mixtures are less efficient during combustion. However, the rich mixture is desirable during cold weather and during starting conditions.

A charge forming device is placed on an engine to mix the air and fuel in the correct proportion (ratio) for various operating conditions. In order to achieve smooth starting for an engine, it has been known to make the air-fuel mixture richer by increasing the fuel feed rate at the carburetor without changing the air feed rate. This has been done by using a positive temperature coefficient (PTC) ceramic heater; such as in combination with a choke valve or enrichment valve. Specifically, when the engine is started, the PTC heater causes a valve to open for a predetermined period of time so that a fuel-rich air-fuel mixture is fed to the engine. Traditionally, the power source for the PTC heater has included a battery in combination with a relay.

As a result of the construction employing a battery, just described, such a known starting arrangement cannot be used with marine propulsion units which have no battery. Even if such a known system could be used with a marine propulsion unit, the device is complicated since it has been the common practice to provide a relay in the circuit in order to energize the PTC heater simultaneously with the turning of the starter switch to the "ON" position.

It is, therefore, a principle object of this invention to provide an improved starting arrangement for a marine propulsion unit.

It is another object of this invention to provide a starting arrangement which has a relatively simple construction and which can be used with propulsion units which do not have batteries.

SUMMARY OF THE INVENTION

The present invention is adapted to be embodied in a fuel enrichment arrangement for the internal combustion engine of a marine propulsion unit which is not provided with a battery power supply. The invention comprises a valve assembly and a fuel feed passage, wherein the valve assembly is positioned along the fuel feed passage so that it can control the flow of fuel therethrough. A positive temperature coefficient heating device is also provided, in association with the valve assembly, for effecting the operation of the valve assembly. Further, a multipolar generator is provided as an exclusive power source for communicating with, and providing power to, the heating device.

DETAILED DESCRIPTION OF THE PREFERRED EMBODIMENT

Figure 1:
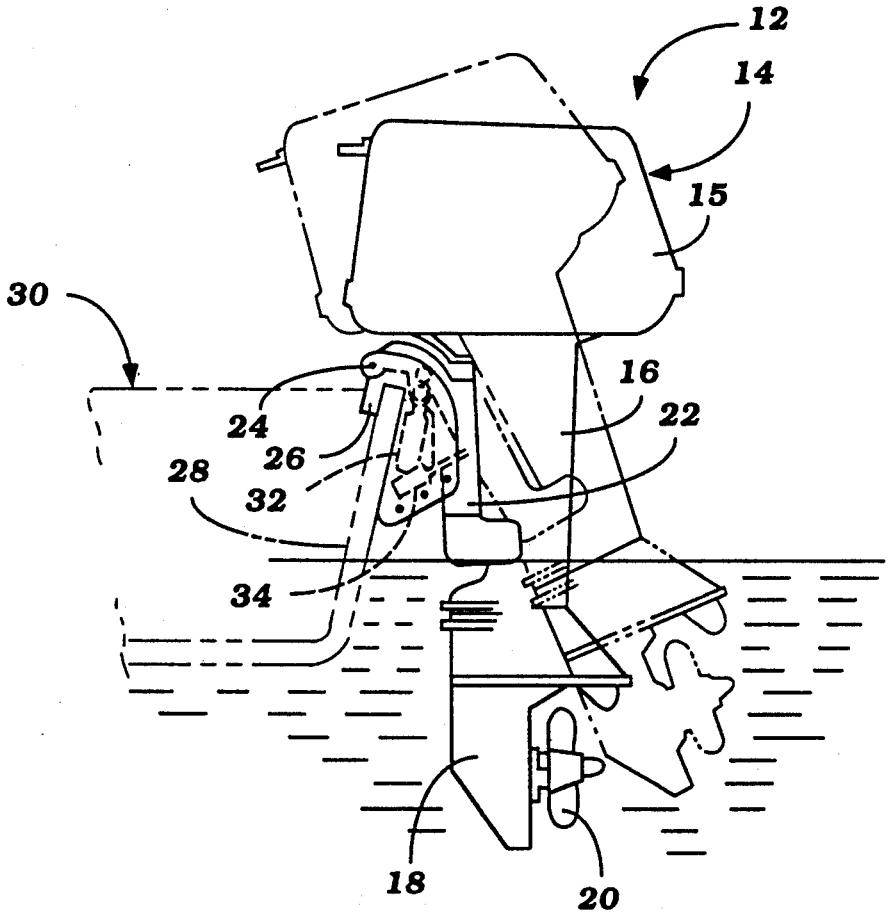
FIG. 1 is a side elevational view of an outboard motor and associated watercraft suitable for use with the present invention.

Referring first to FIG. 1, an outboard motor is illustrated and is referred to generally by the reference numeral 12. The outboard motor 12 of FIG. 1 is a typical environment with which the present invention may be employed; however, the invention is not meant to be specifically limited to such a use.

The outboard motor 12, as illustrated, is comprised of a power head 14 which includes an internal combustion engine, described below, which is positioned within a protective cowling assembly 15. The engine drives a vertically disposed drive shaft (not shown) that is rotatably journalled in a drive shaft housing 16 which depends from the power head 14. The drive shaft housing terminates in a lower unit 18 in a known manner. The drive shaft drives a forward, neutral, reverse transmission (not shown) contained within the lower unit 18 which, in turn, drives a propeller 20 in selected forward and reverse directions.

The drive shaft housing 16 is supported for steering movement about a vertically extending axis by means of a swivel bracket 22. The swivel bracket 22 is, in turn, supported for pivotal movement about a horizontally extending axis by means of a pivot pin 24 and clamp bracket 26. As is well known, the clamp bracket 26 permits attachment of the outboard motor 12 to the transom 28 of an associated watercraft 30 (shown in phantom).

A hydraulic tilt and trim arrangement is interposed between the clamp bracket 26 and the swivel bracket 22 for controlling both the trim and tilt of the outboard motor 12. The tilt and trim unit includes a hydraulically operated tilt cylinder assembly 32 and a pair of hydraulically operated trim cylinder assemblies 34. The outboard motor 12 of FIG. 1 is illustrated in phantom outline in a trimmed up position.

The construction of the outboard motor 12, as thus far described, may be considered to be conventional. For that reason, further details of its construction are not believed to be necessary to understand the construction and operation of the invention.

Figure 2:
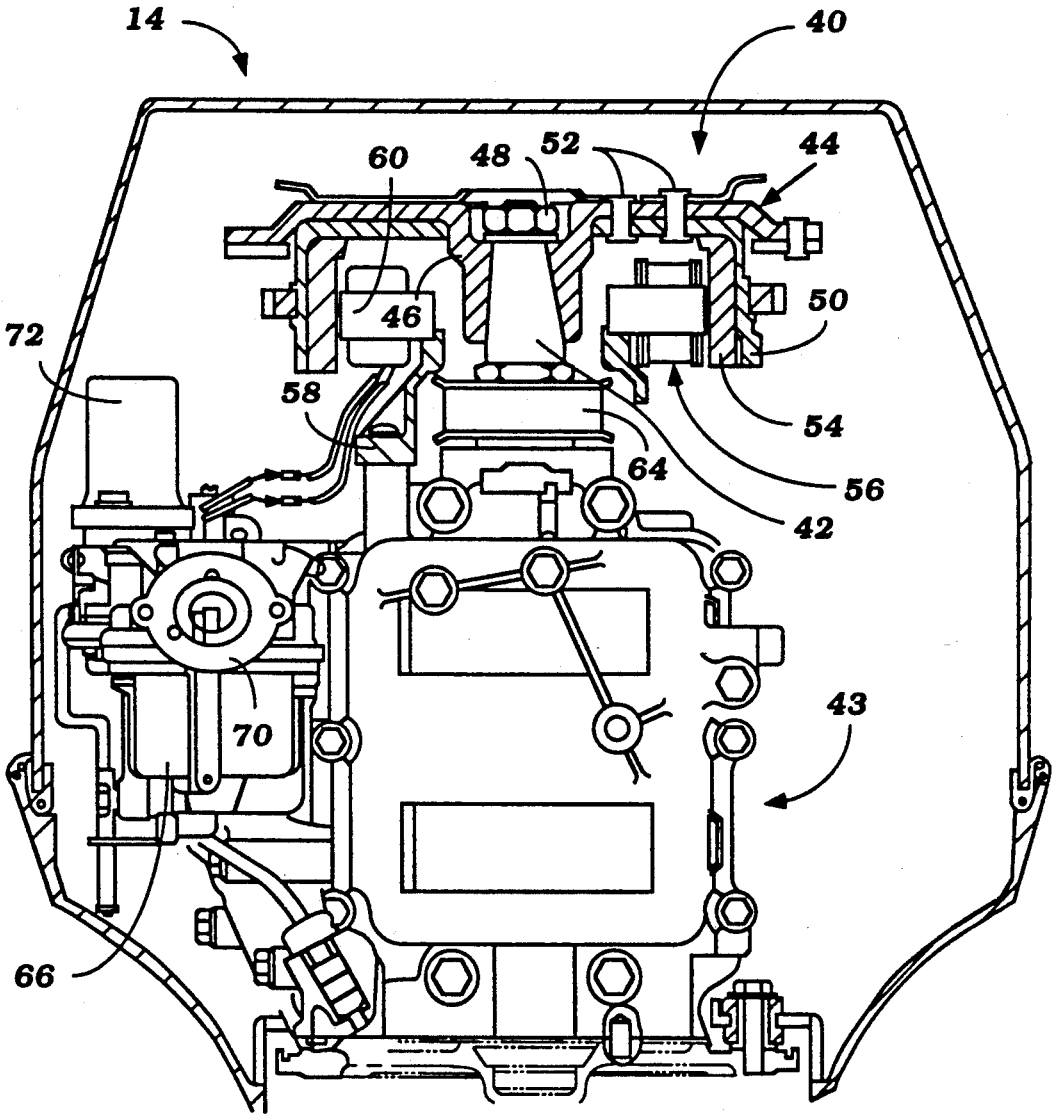
FIG. 2 is an enlarged cross-sectional view taken through the powerhead of the outboard motor, and showing the engine therein and the components of the fuel enrichment arrangement of the present invention.
Figure 3:
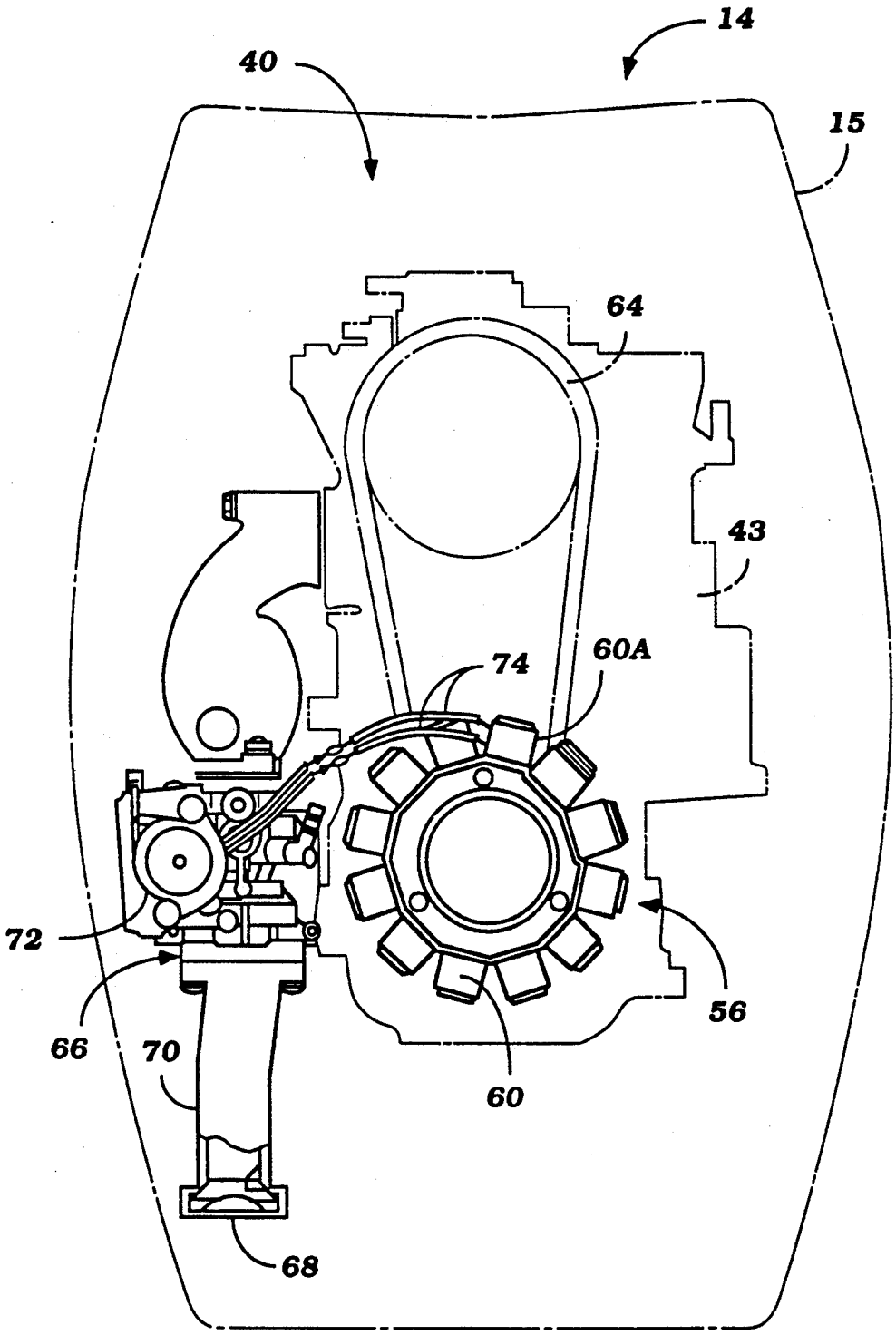
FIG. 3 is a top plan view, with portions shown in phantom and portions broken away, taken through the powerhead of the outboard motor, and showing several components of the fuel enrichment arrangement of the present invention.

Referring next to FIGS. 2 and 3, an internal combustion engine, designated generally by the reference numeral 40, is shown as mounted within the protective cowling 15 of the powerhead 14. A crankshaft portion 42 extends upwardly of the engine body 43 and mounts a rotor 44 at a boss portion thereof 46. The rotor 44 may be fixed to the crankshaft portion 42 by any suitable means, such as by way of a woodruff key and a nut 48, as illustrated in FIG. 2. The rotor 44 has a flanged portion to which a flywheel 50 is fixed by way of rivets 52. A permanent magnet 54 is secured to the inner periphery of the flywheel 50.

A multipolar generator 56 is disposed adjacent to the magnet 50 and is affixed to a support 58 which, in turn, is secured to the engine body 43. The generator 56 comprises a plurality of coils arranged in a circular fashion, collectively designated by the reference numeral 60, just inward of the permanent magnet 54. A belt wheel, about which a cam belt 64 is wound, is provided between the crankshaft 42 and the engine body 43.

Along the front region of the engine body 43, a carburetor 66 is provided for feeding an air-fuel mixture to respective cylinders within the engine. The invention is not limited to use with a carburetor, however; any suitable charge forming device may be employed. An air intake port 68 is provided at one end of an air intake passage 70 which leads into the carburetor 66. A PTC (positive temperature coefficient) heater 72 is provided on the upper side of the carburetor 66 for controlling the fuel-air ratio during the period proximate the starting of the engine 40. The PTC heater 72 is connected to one coil 60A of the plurality of coils 60 by a pair of lead wires 74.

Figure 4:
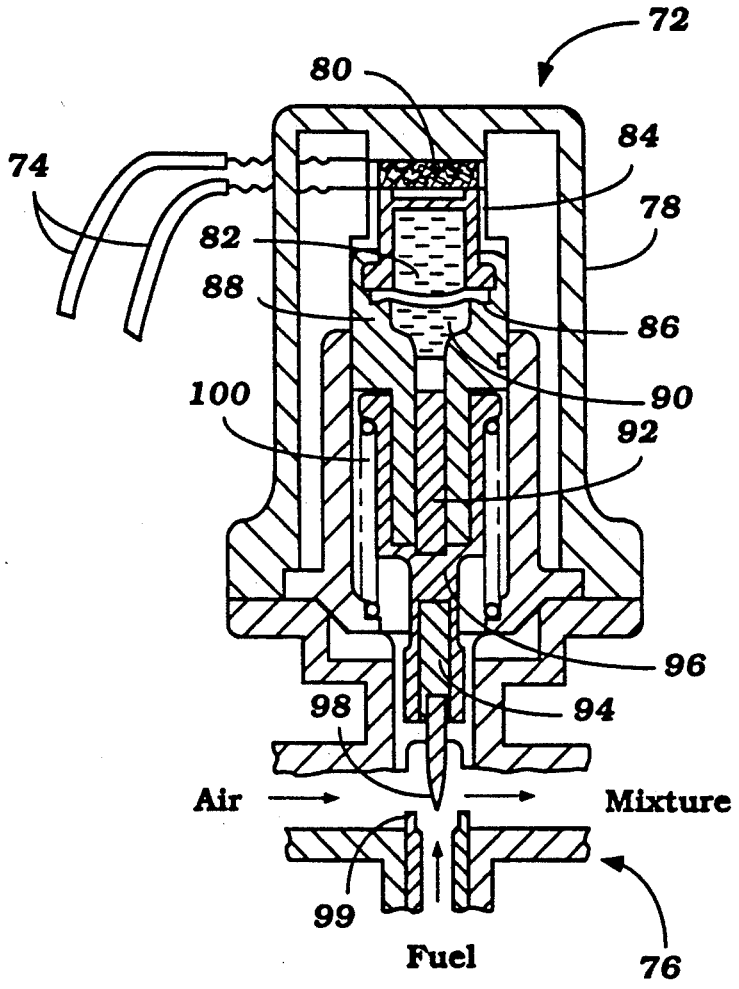
FIG. 4 is a cross-sectional view taken through the PTC heating device and fuel feed passage of the present invention employable for controlling the amount of fuel present in an air-fuel mixture.

Next, the construction of the PTC heater 72 will be described, with particular reference to FIG. 4. As illustrated in the figure, the PTC heater 72 is positioned adjacent to an air/fuel feed passage 76. A casing 78 envelopes the upper region of the PTC heater assembly 72. A PTC thermistor 80 is mounted within an upper portion of the casing 78. The PTC thermistor 80 is connected to one of the coils 60A by lead wires 74, as described above. An expansible thermowax material 82 is located just beneath the PTC thermistor 80 within a holder 84 having a moveable diaphragm 86 secured across its lower side.

Another holder 88 contains a liquid medium 90 and a piston 92, positioned beneath the thermowax material 82. The liquid medium 90 fills a bore of the holder 88 and is bordered, and sealed, at its uppermost area by the diaphragm 86. The liquid medium 90 serves to transmit displacement of the diaphragm 86 due to expansion in the volume of the thermowax material 82, caused by heat emitted from the PTC thermistor 80, to the piston 92. The piston 92 is positioned beneath the liquid medium for movement within the holder, and has its lower face contacting a further, moveable holder 96 which houses a plunger member 94 therein.

The plunger member 94, at its lower end, holds a needle member 98 in place. The needle member 98 is thereby arranged so that it can be extended into, and retracted out of, the feed passage 76. A needle seating 99 is mounted perpendicularly to the flow direction of the feed passage 76 within the fuel line for receiving the lower end of the needle member 98 therein when the needle member is fully extended. Accordingly, the amount of fuel delivered into the feed passage 76 can be regulated by movement of the needle member 98. A return spring 100 biases the plunger holder 96 in a direction tending to retract the needle member 98 out of the feed passage 76.

Next, the operation of the preferred embodiment as set forth above will be described.

Figure 5:
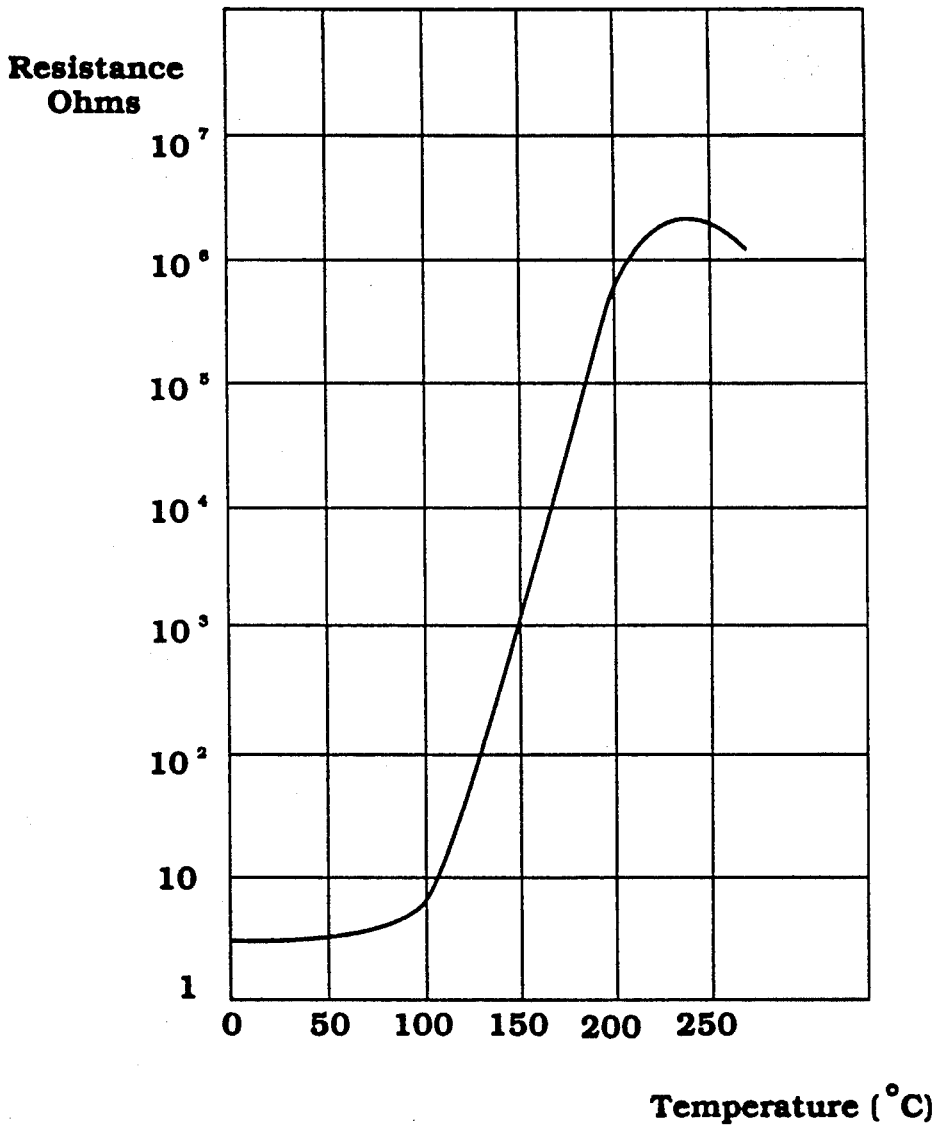
FIG. 5 is a graph showing the temperature-resistance characteristic of the PTC thermistor of the present invention.

The PTC thermistor 80 of the invention has a temperature-resistance characteristic as shown in the graph of FIG. 5. When the engine 40 is started, the thermistor 80 is energized by the coil 60A of the multipolar generator 56 so that the resistance is rapidly increased with the resultant increase in temperature. An equilibrium is rapidly reached at which the heat radiated by the device and the heat generated, based on the difference between the inside temperature and the ambient temperature, are balanced. Since, in the early stage following the starting of the engine 40, the thermowax 82 has not yet been heated by the thermistor, the needle 98 remains located in a retracted position so that it does not block the flow of fuel. Thus, a fuel rich mixture is obtained.

As the engine 40 is warmed up, the thermowax 82 expands so that the needle 98 is moved downward, due to respective downward motion of the diaphragm 86, liquid medium 90, piston 92, plunger holder 96 and plunger 94. Accordingly, the needle blocks the flow of fuel as it approaches the needle seat. In this way the fuel feed can be controlled for a period of time following the starting of the engine 40.

As discussed above, in the conventional starting arrangement, a battery has been used as the power source for a PTC heater. Therefore, such a starting arrangement could not be used for a propulsion unit having no battery. Further, since it has been the practice to provide a relay in the circuit in order to energize the PTC heater simultaneously with the turning of the starter switch to the "ON" position, the construction of the system has been quite complicated.

In contrast, according to the present invention, by connecting the PTC heater 72 directly to the generator coil 60A as a source for power, it is now possible to apply such a starting arrangement to a propulsion unit having no battery. Further, according to the present invention, it is no longer necessary to use a relay and, therefore, the system can be greatly simplified.

Figure 6:
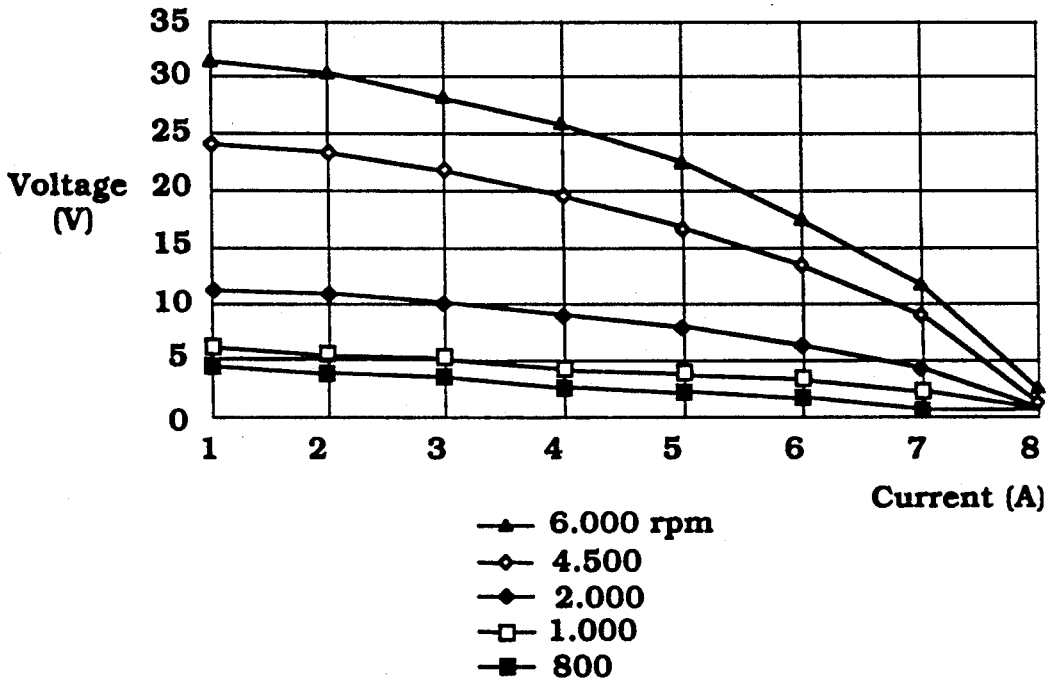
FIG. 6 is a graph showing the current-voltage characteristic of the permanent-magnet generator of the present invention.
Figure 7:
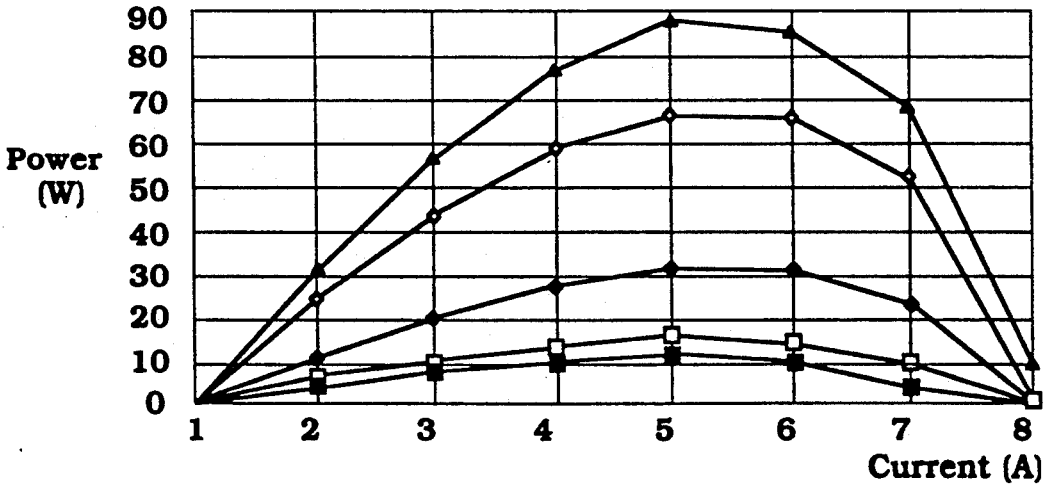
FIG. 7 is a graph showing current-electric power characteristic of the permanent-magnet generator of the present invention.

The current-voltage characteristic of the permanent magnet generator 56 employed in the present invention is illustrated in FIG. 6. As can be seen from the graph of that figure, the voltage is at a low level when a large current is generated, and the voltage increases as the current decreases. FIG. 7 illustrates, in graphical form, the current-electric power characteristic of the permanent-magnet generator 56. As can be seen from that figure, the curve of electric power as a function of current peaks in its mid-range while it is relatively low when the current is either small or large.

By utilizing a permanent magnet generator 56 having the characteristics of FIGS. 6 and 7, just described, in combination with a PTC heater 72 possessing the characteristics exhibited by the graph of FIG. 5, a low resistance and large current are achieved in the early stage during heating of the PTC heater, when the temperature of the heater is relatively low. However, as the temperature of the PTC heater 72 increases, the resistance increases and, accordingly, the electric power generated by the permanent magnet generator 56 becomes lower. As a result, the quantities of heat generation and heat radiation are relatively small when an equilibrium level between these quantities is reached. In this way, the equilibrium temperature of the PTC heater 72 is kept below a maximum temperature tolerable by the thermowax material 82.

The construction of the present invention, as described above with regard to the preferred embodiment, allows for the maintenance of an equilibrium temperature of the heating device 72 at a relatively low level and, thus, alleviates the necessity of employing a voltage-controlling regulator for maintaining the PTC heater temperature below the maximum temperature tolerable by the thermowax material 82. Accordingly, this further serves to keep the system of the invention relatively simple in construction.

It is, of course, desirable that the thermal equilibrium, at a desired level, be maintainable over a wide range of engine revolution speeds. The electric power generated by the permanent magnet generator 56, according to the invention, is constantly controlled in order to maintain a nearly constant desired equilibrium level by utilizing the above-described PTC heater 72 in combination with the permanent magnet generator 56.

Additionally, according to the present invention, the coil 60A employed to provide power to the PTC heater 72 is independent of the remaining coils 60, which coils 60 are used for providing power to various other components. Thus, the power source for the PTC heater 72 is not influenced by the electrical load placed upon such other coils 60 and, therefore, the PTC heater 72 can exhibit stable heating characteristics during its operation.

Figure 4A:
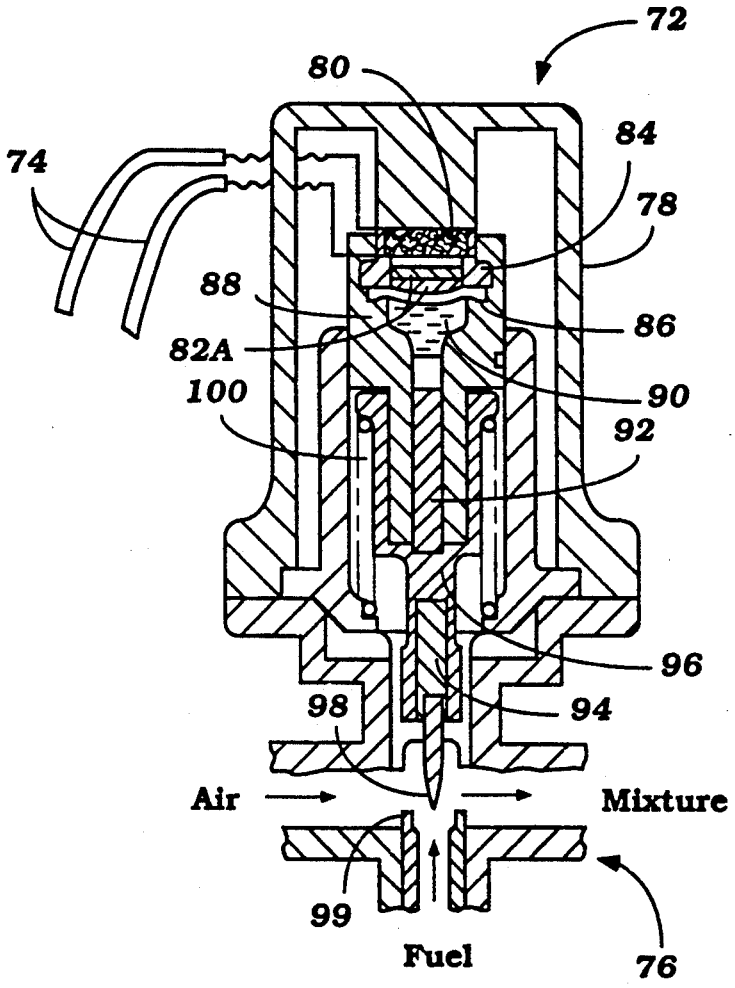
FIG. 4A depicts an alternative embodiment of the invention as shown in FIG. 4.

Although a very effective construction has been illustrated and described above for an improved fuel enrichment arrangement for a marine propulsion unit, and particularly for an arrangement which has a relatively simple construction and which can be used with propulsion units which do not have batteries, the invention is susceptible to various changes and modifications. For example, a bimetallic material (See element 82A of FIG. 4A, wherein like reference numerals indicate like elements with respect to the construction described above) be employed in place of the thermowax material, and a generator other than a permanent magnet type may be utilized. The number of poles to be used exclusively for the PTC heater could be two or more. These, and other, modifications may be made without departing from the spirit and scope of the invention as defined by the appended claims.

We claim:

1. A fuel enrichment arrangement for an internal combustion engine of a marine propulsion unit which is not provided with a battery power supply, comprising: a valve assembly and a fuel feed passage, said valve assembly positioned along said fuel feed passage for controlling the flow of fuel therethrough; a positive temperature coefficient heating device associated with said valve assembly for effecting the operation of said valve assembly; and, further, a multipolar generator as an exclusive power source communicating with and providing power to said heating device.

2. The fuel enrichment arrangement of claim 1 further comprising a carburetor assembly, and wherein said positive temperature coefficient heating device is positioned upon said carburetor assembly for controlling an air-fuel ratio during a period proximate starting of said engine.

3. The fuel enrichment arrangement of claim 1 wherein said heating device comprises a positive temperature coefficient thermistor element and an heat expansible element, said heat expansible element being expandable in response to an increase in the temperature thereof; and wherein said thermistor is located proximate said heat expansible element, for heating said heat expansible element.

4. The fuel enrichment arrangement of claim 3 wherein said heating device further comprises a piston and a valve needle; wherein said piston is located proximate said heat expansible element so that said piston moves in response to expansion of said heat expansible element; and wherein said valve needle is positioned so that said valve needle will extend into said fuel feed passage in response to movement of said piston.

5. The fuel enrichment arrangement of claim 4 wherein said heating device further comprises a spring member tending to bias said valve needle out of said fuel feed passage.

6. The fuel enrichment arrangement of claim 3 wherein said heat expansible element comprises a thermowax material.

7. The fuel enrichment arrangement of claim 3 wherein said heat expansible element comprises a bimetallic device.

8. The fuel enrichment arrangement of claim 3 wherein said multipolar generator comprises a permanent magnet arrangement and a coil assembly, said permanent magnet arrangement located adjacent said coil assembly; and further comprising means for moving said coil assembly by said permanent magnet arrangement, so that said coil assembly cuts magnetic lines of force.

9. The fuel enrichment arrangement of claim 8 wherein said means for moving said coil assembly by said permanent magnet comprises a flywheel, wherein said permanent magnet arrangement is fixed upon said flywheel; and further comprising a rotatable shaft and a cam belt, wherein said flywheel is fixed for movement with said rotatable shaft and said cam belt is wound about said rotatable shaft.

10. The fuel enrichment arrangement of claim 9 wherein said coil assembly comprises a plurality of coils arranged in a circular formation; and further comprising a set of lead wires, said lead wires communicating one coil of said plurality of coils with said positive temperature coefficient thermistor element.

11. The fuel enrichment arrangement of claim 9 wherein said flywheel comprises a portion of a magneto generator.

12. The fuel enrichment arrangement of claim 10 wherein said positive temperature coefficient thermistor element is energized by only one coil of said plurality of coils during said period proximate starting of said engine.

13. The fuel enrichment arrangement of claim 12 wherein said heating device does not heat said heat expansible element to a point of substantial expansion of said heat expansible element until a point in time following said period proximate starting of said engine.

14. The fuel enrichment arrangement of claim 3 wherein said positive temperature coefficient thermistor element has a resistance of between 1 and 10 Ohms in a temperature range of zero to 100 degrees centigrade; and, further, has a resistance of between $10^6$ and $10^7$ Ohms at a temperature of 250 degrees centigrade.

15. The fuel enrichment arrangement of claim 1 wherein a plot of voltage as a function of current provided by said multipolar generator has a negative slope; and, further, wherein said multipolar generator provides a relatively low quantity of electrical power when providing both a high level and a low level electrical current and wherein said multipolar generator provides a relatively greater quantity of electrical power when providing an electrical current level therebetween.

* * * * *